US011946203B2

(12) United States Patent
Theussl et al.

(10) Patent No.: US 11,946,203 B2
(45) Date of Patent: Apr. 2, 2024

(54) DEVICE AND METHOD FOR TRANSFERRING A STRIP OF A WEB

(71) Applicant: ANDRITZ AG, Graz (AT)

(72) Inventors: André Theussl, Graz (AT); Wolfgang Klamminger, Graz (AT); Reinhard Diemat, Kumberg (AT)

(73) Assignee: Andritz AG, Graz (AT)

( * ) Notice: Subject to any disclaimer, the term of this patent is extended or adjusted under 35 U.S.C. 154(b) by 190 days.

(21) Appl. No.: 17/604,121

(22) PCT Filed: Feb. 10, 2020

(86) PCT No.: PCT/EP2020/053328
§ 371 (c)(1),
(2) Date: Oct. 15, 2021

(87) PCT Pub. No.: WO2020/211991
PCT Pub. Date: Oct. 22, 2020

(65) Prior Publication Data

US 2022/0205182 A1 Jun. 30, 2022

(30) Foreign Application Priority Data

Apr. 18, 2019 (AT) ..... A50359/2019

(51) Int. Cl.
*D21G 9/00* (2006.01)

(52) U.S. Cl.
CPC ..... *D21G 9/0063* (2013.01)

(58) Field of Classification Search
None
See application file for complete search history.

(56) References Cited

U.S. PATENT DOCUMENTS

2003/0033727 A1* 2/2003 Stelljes, Jr. ..... D21F 11/145 34/361
2005/0016703 A1* 1/2005 Steiner ..... D21F 3/04 162/358.1
2006/0144538 A1* 7/2006 Schwonke ..... D21D 5/02 162/123

FOREIGN PATENT DOCUMENTS

DE 4314475 A1 12/1993
DE 29913211 U1 * 10/1999 ..... D21F 7/04
DE 102008042282 A1 3/2010
WO 9966122 A1 12/1999
WO 0031336 A1 6/2000

OTHER PUBLICATIONS

English Translation of the description of DE29913211U1 retrieved from Espacenet on Jun. 17, 2023 (Year: 2023).*
International Search Report dated Apr. 22, 2020 for International Patent Application No. PCT/EP2020/053328.

* cited by examiner

*Primary Examiner* — Eric Hug
*Assistant Examiner* — Elisa H Vera
(74) *Attorney, Agent, or Firm* — Alix, Yale & Ristas, LLP

(57) ABSTRACT

The invention relates to a device and a method for transferring the tail of a web from a first clothing to a second clothing. It is characterised in that the tail is transferred in a first, short open draw from the first clothing to the second clothing. This enables automatic web transfer requiring significantly less space and with equipment of low complexity.

18 Claims, 3 Drawing Sheets

DEVICE AND METHOD FOR TRANSFERRING A STRIP OF A WEB

BACKGROUND

The invention relates to a method for transferring the tail of a pulp web from a first clothing to a second clothing of a machine for production of the pulp web, the tail being transferred from the first clothing to the second clothing in a first, short open draw, where the tail continues running on the second clothing and the tail is guided on the second clothing to a second area, and in the second area the tail is carried between the second clothing and a third clothing. The invention also relates to a device for transferring the tail of a pulp web in a machine for production of the pulp web with a first clothing and a second clothing, and with a short open draw for transferring the tail from the first clothing to the second clothing, the second clothing being guided over a roll after the open draw, where a jet from a pneumatic nozzle can be directed towards the first clothing after the open draw and the jet is disposed in a cross-machine area of the first clothing, where the tail is carried on the first clothing before the open draw.

In general, the web in a machine for production of a pulp web is carried on different clothings in order to achieve a desired effect. A distinction can be made between an open and a closed draw with regard to web transfer. In a closed draw, the web is supported on machine clothing, for example, a felt, a wire, a belt, or similar, and guided directly to the next clothing. In an open draw, the web is not supported, i.e. it is guided freely from one clothing to the next. As a result, starting up or repeated transfers are more problematic than with closed draws.

Pulp drying machines process a pulp web consisting mainly of pulp with a typical basis weight of more than 450 $g/m^2$ in production operations. As a rule, the web is transferred from a first clothing, for example the pick-up felt, of a press unit, for example a combi-press, to a second clothing, for example the felt of a shoe press unit, in an open draw. When starting up the machine or during a repeated transfer, the web must be transferred manually in the open draw from the first clothing to the second clothing. To do so, a tail of the web is generally cut in machine direction, for example by a liquid cutting jet directed towards the web that cuts the web into a tail and a remaining part of the web. This tail is transferred by someone manually to the subsequent clothing, i.e. the tail is guided manually within the machine. As manual intervention inside the machine poses a risk to life and limb in areas with roll nip inlets, technical solutions are needed that prevent these risks. Here, the machine runs typically at a speed of 50-200 m/min. When the tail has been transferred successfully, it is then widened, i.e. the width of the tail cut from the web is increased progressively, for example by moving the liquid cutting jet across the machine running direction, causing the tail to cover the entire web width at the end of the widening process and hence transferring the entire web after transfer of the tail.

It should be noted that the strength of a pulp web increases as the dryness content rises. For example, the pulp web typically has a dryness content of <20% before dewatering in a mechanical press, of <60% after dewatering in a mechanical press, and >80% after the thermal drying section. In accordance with the lower dryness content and respective lower web strength in the area of the press, the task of transferring is more difficult than transfer of the web after thermal drying, with the correspondingly higher dryness content and web strength.

WO 00/31336 reveals the typical state of the art for the wet end of a pulp drying machine in FIG. 1. It explains that this arrangement is not sufficient to meet the requirements of higher machine speeds. In particular, transfer of the tail and widening of the web in open areas is a highly complicated procedure that is susceptible to faults.

DE 10 2008 042281 A1 discloses a machine for production of a pulp web with a transfer arrangement for transferring the pulp web to an air-jet drying device and which is characterised in that an open transfer can be achieved by adjusting the operating position of a suction roll.

WO 99/66122 A1 reveals a method and a device for drying pulp, where the wet-end wire is guided according to the invention through at least one nip of a long-nip press and two-sided dewatering takes place in the nip.

SUMMARY

The inventive embodiments provide effective, open web transfer without touching the web by hand and to improve industrial safety. Also provided is a device according to the invention requiring a minimum of space with equipment of low complexity overall.

The disclosed embodiments achieve this by the tail and the web being carried together on the first clothing, which is preferably a felt, through at least one press nip of a suction press roll. At least one other roll presses against the suction press roll here, causing mechanical dewatering of the tail and the web in the press nip formed between the suction press roll and the other roll. The press nip should preferably have two felts, i.e. the other roll that also presses against the suction press roll has a machine clothing, which is preferably a felt as well, wrapped around it too. Hence, the tail and the web are pressed in the press nip between two clothings, which are preferably felts, one of the rolls in the press nip being a suction press roll. After the press nip, the clothing of the other roll is lifted off in order to prevent re-wetting. After the tail has been carried through the at least one press nip on the first clothing together with the web, the tail is carried onwards on the first clothing and the rest of the web follows the clothing of the other roll to a broke area or broke container. The suction press roll has at least one suction zone for applying suction to the first clothing. Advantageously, the suction press roll enables suction to be applied, at least in the area of the tail, to the first clothing after the press nip through which the tail and the web are guided together, causing the tail on the first clothing to be held on the suction press roll on the one hand and minimizing any possible re-wetting after mechanical pressing on the other hand. The machine for production of a pulp web is, in particular, a pulp drying machine. In particular, the arrangement described is a combi-press in a pulp drying machine that has a suction press roll with a first clothing—typically a felt—wrapped round it, having at least one and typically two press nips on the suction press roll. The press nips here have two felts and the tail is carried onwards on the first clothing after the first press nip for transfer purposes, while the remainder of the web is fed to the broke area after the first press nip. The tail on the first clothing is typically transferred to a heavy-duty press, for example a shoe press, after the combi-press. For this purpose, the tail from the first clothing is transferred over a short open draw to the second clothing. Thus, the short open draw enables different speeds to be achieved with the clothings, for example, which can compensate particularly effectively for process-related changes in web length due to stretching or elongation. Here, a short open draw refers to a gap of less than 20 cm, preferably less than 10 cm, and less than 5 cm according to the invention, between the first and the second clothing. The tail is then carried onwards on the second clothing to a second area, this second area being characterised in that it begins at the point where the second clothing meets a third clothing. The second clothing is a felt. The third clothing is a felt as well, but can also be designed as an impermeable belt. According to the invention, the second clothing and the third clothing are the clothings of the heavy-duty press or shoe press.

A favourable embodiment of the method is characterised in that the jet from a pneumatic nozzle acts upon the first clothing after the open draw, at least for a short time, the jet acting in an area of the first clothing across the machine, where the tail is carried on the first clothing before the open draw. The jet from the pneumatic nozzle acts on the first clothing shortly after the end of the open draw, the pneumatic nozzle jet acting in a cross-machine area of the first clothing viewed in cross-machine direction, where the tail is carried on the first clothing before the open draw. During transfer, the pneumatic nozzle jet assists with handover of the tail to the second clothing, i.e. a tail running on the first clothing is detached from the first clothing by the jet, the tail detached from the first clothing being placed on the second clothing by the action and direction of the jet.

A favourable embodiment of the method is characterised in that a jet from a water nozzle acts upon the second clothing shortly before the open draw, the jet acting in an area of the second clothing across the machine, where the tail is carried on the second clothing after the open draw. The jet of the water nozzle is directed preferably towards the machine side of the second clothing, the machine side of the clothing being the side opposite the side on which the pulp web rests. The water nozzle is disposed, for example, shortly before the roll over which the second clothing is guided to the area of the open draw, the roll being either a grooved or a perforated roll. Due to the jet from the water nozzle, the second clothing is saturated with water in the effective range of the jet, causing an increase in the smoothness of the second clothing on the web side and reducing the permeability of the clothing. In accordance with the well-known "pane of glass" effect, the tail preferably follows the second clothing in the first zone and is transferred from the less "smooth" and more permeable first clothing to the "smooth" and less permeable second clothing.

A favourable embodiment of the method is characterised in that the tail and the web are guided together with at least the first clothing through at least one press nip, suction being applied to the tail through the first clothing between the press nip and before the open draw. Here, the machine for production of a pulp web is, in particular, a pulp drying machine, the first clothing, which is preferably a felt, being guided round a suction press roll. At least one other roll presses against the suction press roll. Advantageously, the suction press roll enables suction to be applied to the first clothing at least once after the press nip through which the tail and the web are carried together. In this way, the tail carried on the first clothing is held or secured more effectively on the suction press roll on the one hand, and on the other hand, any possible re-wetting after mechanical pressing is kept to a minimum.

Another favourable embodiment of the method is characterised in that at least the tail is subjected to suction through the second clothing after the open draw. As a result, the tail is transferred from the first clothing to the second clothing in the open draw. Securing of the tail on the second clothing is improved according to the invention in that the suction is applied to the second clothing at least in the area of the tail. It is especially advantageous if suction is applied to the second clothing primarily in the area of the tail during transfer of the tail and thus the vacuum available is directed towards this area. However, when the tail has been transferred and widened, suction can also be applied to the second clothing in the area of the full web, in particular causing the entire web to be secured and preventing folding and bubbles forming in the web on the second clothing.

Another favourable embodiment of the method is characterised in that at least the tail is subjected to suction through the second clothing, at least in places, after the open draw and before the second area. The tail carried on the second clothing is guided onwards to a second area, the second area being characterised in that it begins at the point where the second clothing with the tail meets a third clothing. Securing of the tail on the second clothing after the open draw is improved according to the invention in that suction is applied to the second clothing, at least in the area of the tail. It is especially advantageous if suction is applied to the second clothing primarily in the area of the tail during transfer of the tail and hence the vacuum available is directed towards this area. However, when the tail has been transferred and widened, suction can also be applied to the second clothing in the area of the full web, in particular causing the full web to be secured and preventing folding in the web on the second clothing. Suction can be applied after the open draw and before the second area by means of a suction box.

An advantageous embodiment of the method is characterised in that the second clothing between the open draw and the second area is guided over a suction box and suction is applied to the second clothing by the suction box. Suction is preferably applied by the suction box to the second clothing in the area of the tail while the tail is being transferred in order to secure the tail on the second clothing. Hence, the vacuum available is directed towards this area. However, when the tail has been transferred and widened, suction can also be applied to the second clothing by the suction box in the area of the full web, in particular causing the full web to be secured and preventing folding in the web on the second clothing.

An advantageous embodiment of the method is characterised in that suction is applied to the second clothing indirectly by a suction box after the open draw. This can be achieved, for example, by guiding the second clothing over a roll, being designed as a grooved roll, and the suction box outside the roll applying suction directly to the grooves in the roll and indirectly to the second clothing. This can also be achieved, for example, by guiding the second clothing over a roll, being designed as a perforated roll, and the suction box outside the roll applying suction directly to the perforated roll and indirectly to the second clothing. In the case of the grooved roll, suction can be applied to the area of the tail or to the entire area by designing the suction box in such a way that suction is applied to the grooves in the area of the tail or over the entire web. In the case of the perforated roll, internals such as compartments can be provided inside the roll in order to direct suction towards the tail area only or to the area of the entire web, where the suction box can also be prepared for applying suction to individual zones in this case as well. The suction box for applying suction indirectly to the second clothing can be designed such that only indirect application of suction to the second clothing by the suction box is intended. Or the suction box can also be designed such that suction is applied indirectly and directly to the second clothing by guiding it over the suction box. Applying suction indirectly to the second clothing has the advantage that a much more compact design is possible and only the suction box has to be connected to the vacuum or negative pressure system of the machine if suction is applied to the second clothing indirectly and directly at the same time and the suction effect can be extended to both the suction box and the roll. As a rule, there is no need to connect the roll directly to the machine's vacuum or negative pressure system. The roll according to the invention, designed as a grooved roll or a perforated roll to which suction is applied around its circumference, can have a compact design in particular. As a rule, suction is applied through the hub to suction rolls connected directly to the vacuum or negative pressure system, requiring a design with a larger hub diameter and hence, a larger bearing design. Suction rolls of this kind to which suction is applied through the bearing assembly are complex in terms of engineering and the design requires them to have a feasible minimum diameter. The roll according to the invention to which suction is applied indirectly by the suction box, designed as a grooved roll or a perforated roll to which suction is applied around the circumference, allows smaller minimum diameters to be achieved.

An advantageous embodiment of the method is characterised in that the tail cut out of the web is widened when it has passed through the second area and the full web is guided through the second area after widening. Guiding the tail successfully through the second area means successful transfer of the tail and subsequently, the width of the tail cut out of the web can be increased progressively, for example by moving the liquid cutting jet that cuts the tail out of the web in cross-machine direction. By moving the liquid cutting jet in cross-machine direction, the width of the tail is increased progressively until the tail is as wide as the entire web. Hence, the entire web is also transferred to the second area when the tail has been transferred and widened. The widening process is thereby complete. In the case described, transfer of the tail coming from a combi-press and guided on a first clothing, preferably a felt, to a second clothing, preferably also a felt, is completed, the tail on the second clothing being guided together with a third clothing into a second area and onwards into a heavy-duty press, which is typically a shoe press.

An advantageous embodiment of the method is characterised in that the web consists mainly of pulp and has a basis weight of more than 450 g/m$^2$. The invention is particularly well suited to transferring a tail from the combi-press into a heavy-duty press, particularly a shoe press, in a pulp drying machine. According to the invention, a tail with a basis weight of more than 450 g/m$^2$ is to be transferred in a machine of this kind. However, in a pulp drying machine the possibility of a tail with a basis weight of less than 450 g/m$^2$ being transferred for process reasons—for example to keep the amount of broke produced during transfer down—cannot be ruled out. Nevertheless, this in no way contradicts the applicability of the invention for transferring tails in a pulp drying machine.

Another favourable embodiment of the method is characterised in that the tail is cut over the entire width of the tail across the machine running direction before the open draw. Thus, a liquid cutting jet is used to cut a tail out of the web in machine direction and to divide the web into a tail and a remaining web. According to the invention, the tail is now cut before the open draw, advantageously before the press nip, in cross direction over the entire width of the tail. This can be performed with the cutting jet of a nozzle, the cutting jet acting across the machine direction over the entire width of the tail. By cutting through the tail over its entire width, the tail, which per se is continuous, is cut in two, in particular the tail upstream of the cut being transferred to the second clothing during web transfer.

The object of the invention is also a device for transferring the tail of a pulp web in a machine for production of a pulp web according to independent claim 12. There is a short open draw between the first clothing and the second clothing so that the web changes from the first clothing to the second clothing in the area of a short open draw. Here, a short open draw refers to a gap of less than 20 cm, preferably less than 10 cm, and less than 5 cm according to the invention, between the first and the second clothing. The pneumatic jet directed towards the first clothing shortly after the open draw ensures that a tail running on the first clothing is lifted off the first clothing and placed on the second clothing.

A preferred embodiment of the device is characterised in that the roll is a grooved or a perforated roll, and suction can be applied indirectly to the second clothing after the open draw, at least in the area of the tail, by a suction box applying suction directly to the grooves in the roll or by the suction box applying suction directly to the perforated roll. Due to the design of the roll as a grooved or perforated roll, where suction can be applied to the roll by a suction box outside the roll, the roll can have a very compact design.

An equally advantageous embodiment of the device is characterised in that the first clothing is wrapped round the suction press roll and the suction press roll has at least one suction zone for applying suction to the first clothing in the area after the press nip, and in that the second clothing is guided over a suction box after the open draw, where the suction box can at least apply suction to the second clothing in the area of the tail. While the tail is being transferred, it is an advantage to apply suction to the first clothing after the press nip, at least in the area of the tail, by means of the suction press roll. This enables the tail to be secured on the first clothing after the press nip. It is also advantageous to apply suction to the first clothing after the press nip with regard to re-wetting of the tail or web. After the open draw, the tail can be secured more effectively on the second clothing, at least in the area of the tail, by applying suction to the second clothing, the second clothing being guided over a suction box with which suction can be applied to the clothing. After widening of the tail, both the suction press roll and the suction box advantageously enable suction to be applied over the entire web width.

BRIEF DESCRIPTION OF THE DRAWINGS

The invention will now be described using the examples in the drawings.

DETAILED DESCRIPTION

Figure 1:
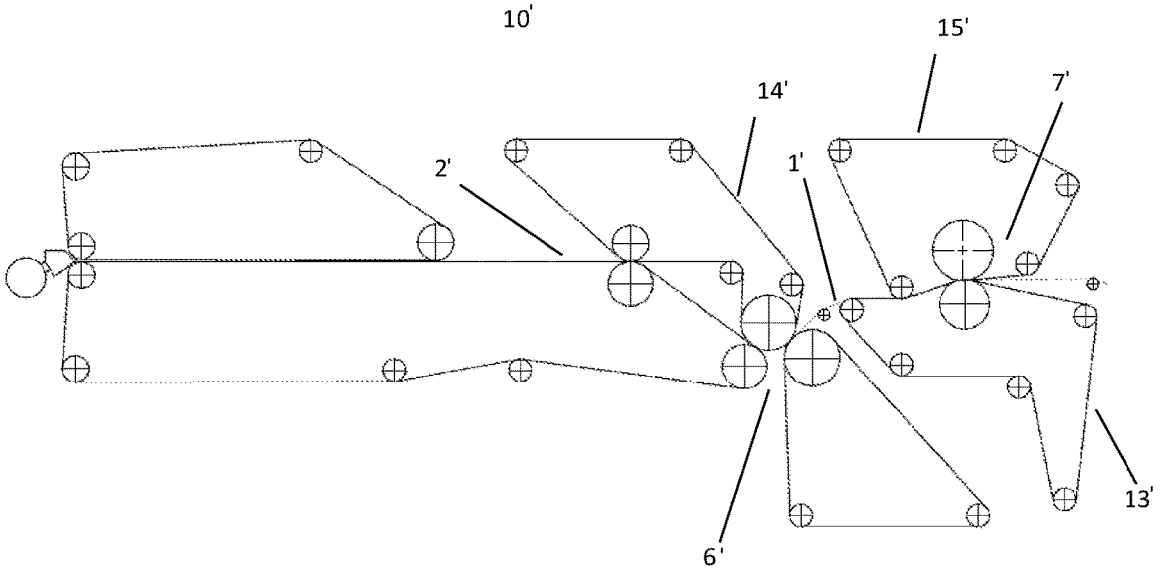
Fig.1 (Prior Art)
FIG. 1 shows a machine for production of a pulp web according to the state of the art.

FIG. 1 shows an overview of the sheet forming unit and the press section of a machine 10' for production of a pulp web according to the state of the art. The sheet forming unit for forming the sheet 2' is designed as a twin-wire dewatering unit and the press section is designed with a first press unit 6' and a subsequent press unit 7'. Other units coming after the machine are not shown. In accordance with the open draw between the first press unit 6' and the subsequent press unit 7', a tail 1' of the web 2' is transferred first of all and then widened to the machine width. An endless woven clothing 14' of the first press unit 6' and the endless woven clothings 13' and 15' of the subsequent press unit 7' are also shown. According to FIG. 1', the web 2' runs from left to right.

Figure 2:
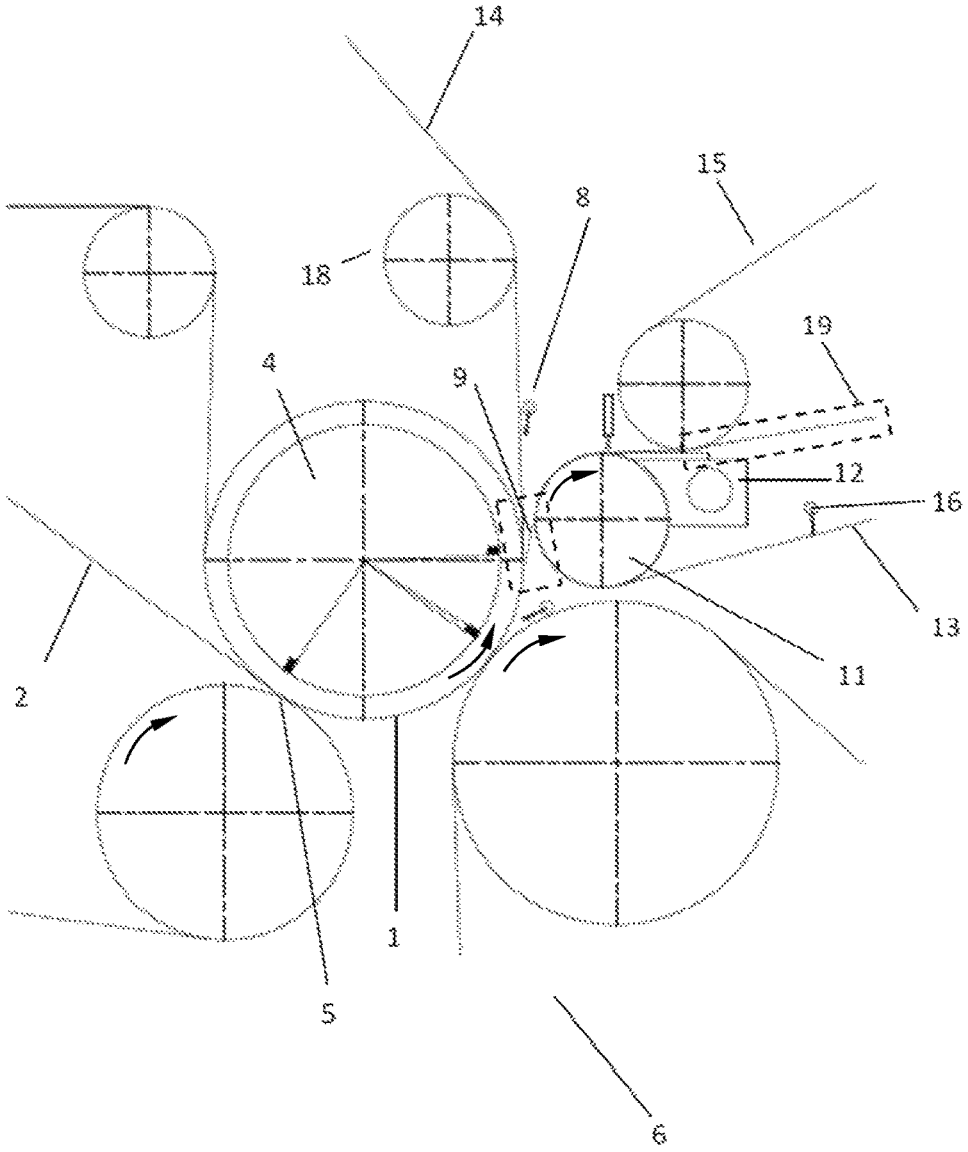
FIG. 2 shows an embodiment of the disclosed device with a short open draw for transferring a tail.

FIG. 2 shows the disclosed device and illustrates the method for transferring the tail 1. Here, the tail 1 is cut from the web 2 in the first press unit 6 before the press nip 5, and the tail 1 and the remaining web 2 are guided through the press nip 5 on the first clothing 14. The remaining web 2 is removed from the first clothing 14 after the press nip 5 and runs into a broke area or broke container (not shown). The tail 1 is carried onwards on the first clothing 14 round the suction press roll 4, enabling suction to be applied to the first clothing 14, at least in the area of the tail 1, by the suction press roll 4, at least after the press nip 5. The tail 1 is transferred from the first clothing 14 to the second clothing 13 in an open draw 9, the second clothing 13 being guided over a roll 11, which is designed as a grooved roll 11 or as a perforated roll 11. Here, the roll 11 enables suction to be applied to the second clothing 13, at least in the area of the tail 1. During transfer, the jet from the nozzle 8 acts on the first clothing 14, at least for a short time, the jet from the nozzle 8 acting at least in the cross-machine area of the first clothing shortly after the open draw 9 (as shown in FIG. 2), where the tail 1 is carried on the first clothing 14 before the open draw. After the open draw 9 and before the second area 19, the clothing is guided over a suction box 12, where suction is applied to the second clothing 13 by the suction box 12, at least in the area of the tail. The suction box 12 furthermore enables suction to be applied indirectly to the second clothing 13 after the open draw 9, the suction box 12 applying suction to the roll 11, which is designed as a grooved roll 11 or perforated roll 11, directly round the circumference. The second area 19 is characterised by the third clothing 15 being placed on the second clothing 13 carrying the tail 1. The jet of the water nozzle 16 can act on the second clothing 13, acting in a cross-machine area of the second clothing 13, where the tail 1 is carried on the second clothing 13 after the open draw 9. Due to the jet of the water nozzle 16, the second clothing 13 can be saturated with water in the effective range of the jet during transfer, increasing the smoothness of the second clothing 13 on the web side and reducing the permeability of the second clothing 13. When the tail 1 has been guided successfully through the second area 19, transfer of the tail 1 is complete, the tail subsequently being widened. After widening, the tail 1 has the full width of the web 2, the web 2 being guided through the press nip 5 and the entire web 2 onwards over the suction roll 4 on the first clothing 14. After the press nip 5, suction can be applied to the web 2 through the first clothing 14 by the suction roll 4. In accordance with the open draw, there is a gap between the first clothing 14 and the second clothing 13, i.e. they do not touch one another, and the web 2 is transferred freely from the first clothing 14 to the second clothing 13. The advantage of an open draw is, in particular, the option of different speeds between the first clothing 14 and the second clothing 13, whereby, the speed of the clothings in machine direction remains the same or increases. After widening, the second clothing 13 has either the same speed as or a higher speed than the first clothing 14. As the speed increases in machine direction, elongation of the web can be compensated, thus preventing bubbles or streaks from forming.

Figure 3:
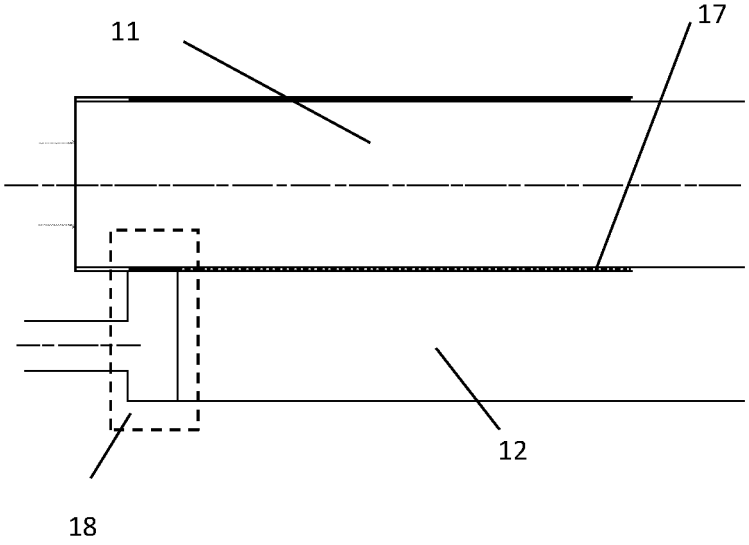
FIG. 3 shows an embodiment of the disclosed suction box for applying suction directly to a roll and indirectly to the second clothing.

FIG. 3 shows the roll 11, which can be designed as a grooved roll 11 or a perforated roll 11, suction being applied to the roll 11 directly around the circumference by the suction box 12. The grooves 17 in the roll 11 or, alternatively, the perforated suction width 17 of the roll 11 is shown in FIG. 3. During transfer of the tail 1, it is an advantage if suction is applied to the second clothing 13, at least in the area of the tail. The suction box 12 can be designed with a separate edge zone 18 in order to concentrate the application of suction on the area of the tail 1 during transfer of the tail 1. After widening, it can be an advantage to apply suction over the entire width of the web 2 in order to secure the web 2 more effectively on the second clothing 13 and prevent bubbles and streaks from forming.

The present invention thus offers advantages over conventional transfer devices. In addition to automatic web transfer without touching the web by hand and the resulting improvement in industrial safety, the invention enables automatic transfer in a very small space with an overall reduction in mechanical engineering complexity.

The invention claimed is:

1. A method for transferring a tail (1) of a pulp web (2) from a first clothing (14) to a second clothing (13) in a first open draw (9) in a machine (10) for production of the pulp web, comprising steps of guiding the tail cut from the pulp web through at least one press nip, after the at least one press nip, transferring the tail of the pulp web in the first open draw to the second clothing, moving the tail (1) onwards with the second clothing (13) with the tail (1) being guided on the second clothing (13) to a second area (19), carrying the tail (1) in the second area (19) between the second clothing (13) and a third clothing (15), wherein the tail (1) and a remaining section of the pulp web (2) are carried together on the first clothing (14) through the at least one press nip (5) between a suction press roll (4) and at least one other roll (6) to mechanically dewater the tail and the remaining pulp web in the at least one press nip (5), carrying the tail (1) onwards on the first clothing (14) while the remaining pulp web (2) follows a clothing of the other roll (6) to a broke area, wherein the second clothing (13) is a felt, and the third clothing (15) is a felt or impermeable belt.

2. The method according to claim 1, wherein a jet from a pneumatic nozzle (8) acts upon the first clothing (14) after the open draw (9), the jet acting in a cross-machine area of the first clothing (14), where the tail is carried on the first clothing (14) before the open draw (9).

3. The method according to claim 1, wherein the tail (1) is subjected to suction through the first clothing (14) between the press nip (5) and the open draw (9).

4. The method according to claim 1, wherein at least the tail (1) is subjected to suction through the second clothing (13) after the open draw (9).

5. The method according to claim 4, wherein suction is applied to the second clothing (13) indirectly by a suction box (12) after the open draw (9).

6. The method according to claim 5, wherein the second clothing (13) is guided over a roll (11) after the open draw (9), the roll (11) is selected from a grooved roll (11) with grooves or a perforated roll (11), and the suction box (12) applies suction directly to the grooves in the grooved roll (11) or directly to the perforated roll (11), thereby indirectly applying suction to the second clothing (13) by the suction box (12).

7. The method according to claim 1, wherein at least a portion of the tail (1) is subjected to suction through the second clothing (13) after the open draw (9) and before the second area (19).

8. The method according to claim 7, wherein the second clothing (13) is guided over a suction box (12) between the open draw (9) and the second area (19) and suction is applied to the second clothing (13) by the suction box (12).

9. The method according to claim 1, wherein the tail (1) cut out of the pulp web (2) is widened when it has passed through the second area (19) and the full pulp web is guided through the second area (19) after widening.

10. The method according to claim 1, wherein the pulp web (2) comprises primarily pulp and has a basis weight of more than 450 g/m$^2$.

11. The method according to claim 1, wherein the tail (1) is cut over its entire width across a machine running direction before the open draw (9).

12. A machine (1) for production of a pulp web with a device for transferring a tail (1) of the pulp web (2), comprising:

a first clothing (14) and a second clothing (13), the first clothing carrying the tail cut from the pulp web through at least one press nip formed between a suction press roll and at least one other roll, an open draw (9) for transferring the tail (1) from the first clothing (14) to the second clothing (13), a roll (11) for guiding the second clothing (13) after the open draw (9), and a jet from a pneumatic nozzle (8) that can be directed onto the first clothing (14) after the open draw, the jet being disposed in a cross-machine area of the first clothing (14), wherein the tail (1) is carried on the first clothing (14) before the open draw (9), the tail (1) and the remaining pulp web (2) can be carried together on the first clothing (14) through the at least one press nip (5), the tail (1) can be carried onwards on the first clothing (14) and the remaining pulp web (2) can be carried onwards on a clothing of the other roll (6) to a broke area.

13. The machine according to claim 12, wherein the roll (11) is a grooved roll with grooves or a perforated roll (11), the second clothing is a felt, and suction can be applied indirectly to the second clothing (13) after the open draw (9) at least at a portion of the tail (1) by a suction box (12) applying suction directly to the grooves in the grooved roll (11) or by the suction box (12) applying suction directly to the perforated roll (11).

14. The machine according to claim 12, wherein the first clothing (14) is wrapped around the suction press roll (4) and the suction press roll (4) has at least one suction zone for applying suction to the first clothing (14) in an area after the press nip (5), and the second clothing (13) is guided over a suction box (12) after the open draw (9) and the suction box (12) can apply suction to the second clothing (13) in an area of the tail (1).

15. A machine for production of a pulp web having a basis weight of more than 450 g/m$^2$ in a manner that allows automatic transfer of a tail of the pulp web, the machine comprising:

at least one press nip formed between a suction press roll and at least one other roll and being arranged to dewater the tail cut from the pulp web, a first clothing carrying the tail cut from the pulp web having a basis weight of more than 450 g/m$^2$ through the at least one press nip, an open draw arranged after the at least one press nip and for transferring the cut tail from the first clothing to a second clothing, said open draw being defined by a gap between the first clothing and the second clothing whereby the first clothing and the second clothing do not touch one another and the pulp web is not supported and is guided freely, a roll for guiding the second clothing after the open draw, and a pneumatic nozzle directing a jet onto the first clothing after the open draw, the jet being disposed in a cross-machine area of the first clothing.

16. The machine according to claim 15, wherein the roll is a grooved roll with grooves or a perforated roll, the second clothing is a felt, and suction can be applied indirectly to the second clothing after the open draw at least at a portion of the tail by a suction box applying suction directly to the grooves in the grooved roll or by the suction box applying suction directly to the perforated roll.

17. The machine according to claim 15, wherein the second clothing moves at a different speed than the first clothing.

18. The machine according to claim 15, wherein the second clothing moves at a greater speed than the first clothing.

* * * * *